US005567380A

United States Patent [19]

Hoover

[11] Patent Number: 5,567,380

[45] Date of Patent: Oct. 22, 1996

[54] ROTARY RETORT HEAT TREATING FURNACE SEALS

[76] Inventor: Donald P. Hoover, P.O. Box 13957, Savannah, Ga. 31416

[21] Appl. No.: 316,421

[22] Filed: Sep. 30, 1994

[51] Int. Cl.[6] ..... C21B 11/06

[52] U.S. Cl. ..... 266/173; 277/12; 266/287

[58] Field of Search ..... 266/173, 287; 277/90, 12, 3; 432/115, 118

[56] References Cited

U.S. PATENT DOCUMENTS

| | | | |
|---|---|---|---|
| 4,087,334 | 5/1978 | Harig et al. | 202/269 |
| 4,338,080 | 7/1982 | Grandcolas et al. | 432/115 |
| 4,343,478 | 8/1982 | Morgan et al. | 277/90 |
| 4,457,520 | 7/1984 | Grachtrup | 277/12 |
| 4,545,764 | 10/1985 | Gillies et al. | 432/115 |
| 4,804,195 | 2/1989 | Parker | 277/12 |
| 5,078,836 | 1/1992 | Hogan | 201/7 |
| 5,106,105 | 4/1992 | Drexler | 277/3 |
| 5,256,250 | 10/1993 | Pelzer | 159/6.3 |

*Primary Examiner*—Scott Kastler
*Attorney, Agent, or Firm*—Greenblum & Bernstein P.L.C.

[57] ABSTRACT

The present invention provides a seal ring assembly for sealing a discharge end of a rotary retort heat treating furnace. The furnace contemplated by this invention has an outer furnace shell, a retort chamber, a rear plug, a cone casting, and a support ring. The cone casting is positioned at the discharge end of the retort chamber and the cone casting and the support ring are fixedly attached to rotate together with the retort chamber. The seal rings of the present invention are aluminum-bronze annular members fixedly attached to the discharge end of the rotary retort furnace. A gasket provides a simple static biasing arrangement to ensure contact between the face of the seal and the support ring. The seal is formed at a wear surface between the face of the aluminum-bronze seal and the support ring. The wear surface is lubricated by a plurality of graphite inserts.

15 Claims, 4 Drawing Sheets

ROTARY RETORT HEAT TREATING FURNACE SEALS

BACKGROUND OF THE INVENTION

1. Field of the Invention

The present invention relates to seal rings in a rotary retort heat treating furnace. The instant invention discloses seals which have a much longer useful life than those presently in use and a method of installing these seals on the rotary retort heat treating furnace.

2. Description of Background Information

Rotary retort heat treating furnaces were developed in the 1950's and are currently used to harden and temper steel fasteners and bearings. It is known that this style furnace consists of an outer shell and an inner screw chamber, or retort, which turns about a longitudinal axis, advancing product to be hardened therethrough. The operating temperatures of conventional rotary retort heat treating furnaces are approximately 1600° F. The product is stirred and advanced along the length of the rotating retort until it is dropped out of the discharge end into a quick cool quench.

To prevent the steel product from reacting with regular or ambient air and consequently oxidizing, the rotary retort contains a protective atmosphere. When the rotary retort furnace was first developed they were shipped with brass seal rings. Because of difficulty in fit, those brass seals were replaced by asbestos rope gaskets.

Because of federal regulations, asbestos rope gaskets were no longer an available alternative as a furnace seal. As a result, asbestos rope gaskets were replaced by fiberglass seals. Because of the intense heat and constant wearing that these fiberglass rope gaskets are subjected to, some have a reported useful life of less than three months.

HARIG et al., U.S. Pat. No. 4,087,334, discloses a seal arrangement for a rotary drum assembly treating materials in a temperature range of 1500° F and 1800° F. The seals maintain a preselected pressure within the drum. The seal assembly is comprised of a rotating seal and a static seal providing a seal between the center breach housing and the rotating drum members. FIG. 10 shows the rotating seal 232 and the static seal 248 kept in contact by a piston rod 260. The seals prevent the escape of gas from the internal portions of the balling drum and the hardening drum through the center breach. This device, while similar to the present invention, suffers in several ways. The metal-to-metal wear face of this device is variable and not fixed, thus requiring piston rods to constantly hold the seal members together in sealing contact. Further, no graphite inserts are disclosed between the wear faces to ensure constant lubrication of the surfaces. Additionally, this invention only seals the outer shell, not the inner shell, as in the present invention.

GRANDCOLAS et al., U.S. Pat. No. 4,338,080, discloses a seal assembly for a cement manufacturing rotary kiln. The background of the invention states that the internal temperatures of the kiln to be in excess of 1000° C. The seal is comprised of a plurality of contacting graphite elements. The graphite members are held against the surface of the kiln by a flexible clamping cable. The patent also discloses alternative sealing material depending upon the conditions of use. Low density graphite is softer and lessens the possibilities of leaks, but also wears faster in abrasive conditions. Resin impregnated graphites are another alternative depending upon the operating temperature of the seal. This patent discloses seals of graphite or graphite impregnated resins, and not the seal of the present invention.

Because the seal of the present invention is comprised of an aluminum-bronze material, it does not suffer the shortcomings of the graphite or graphite impregnated resin of wearing out prematurely due to abrasion and excessive heat.

GRACHTRUP, U.S. Pat. No. 4,457,520, discloses sealing the gap between a rotary kiln and an inlet housing. This invention includes means for sealing the kiln in both the longitudinal and rotational directions. The rotating seal is shown in FIG. 1 as wearing surfaces 15, 15*a*, 16 and 16*a*. The wearing surfaces are held in sealing contact by means of pressure. The wearing surfaces are made "from a suitable material." This device suffers in that it requires additional equipment to provide pressure to hold the seals in constant contact. The present invention includes a fixed seal, and thus does not require the added structure and expense of providing longitudinal contacting members or pressure.

HOGAN, U.S. Pat. No. 5,078,836, discloses an apparatus and method for thermally treating feed material, such as solid waste. The apparatus comprises coaxial rotating drums and a rotating spiral insert for advancing the product through the drum. The treating temperatures in the drums are in excess of 1500° F. While the structure of this retort device is similar to the rotating retort heat treating furnace of the present invention, the composition of the seals is not disclosed. However, the background of the invention does note that these seals for sealing such retorts are exposed to high temperatures and subject to failure due to such extreme temperatures.

SUMMARY OF THE PRESENT INVENTION

The object of the present invention is to provide seal rings for a rotary retort heat treating furnace which have a useful life longer than those existing in the prior art. The present invention employs graphite inserts spaced within the surface of the aluminum-bronze seal rings to act as a lubricant.

The present invention provides a seal ring assembly for sealing a discharge end of a rotary retort heat treating furnace. The furnace contemplated by this invention has an outer furnace shell, a retort chamber, a rear plug, a cone casting, and a support ring. The cone casting is positioned at the discharge end of the retort chamber and the cone casting and the support ring are fixedly attached to rotate together with the retort chamber. The seal rings of the present invention are aluminum-bronze annular members fixedly attached to the discharge end of the rotary retort furnace. A gasket provides a simple static biasing arrangement to ensure contact between the face of the seal and the support ring. The seal is formed at a wear surface between the face of the aluminum-bronze seal and the support ring. The wear surface is lubricated by a plurality of graphite inserts.

It is another object of the present invention to provide a seal ring assembly which includes a metal annular member of aluminum-bronze. The metal annular member also includes a plurality of circular bores fitted with graphite inserts to lubricate the wear surface.

It is a further object of the present invention to provide a seal ring assembly in which the seal is an atmosphere seal. This seal is used to keep gasses inside of the retort chamber and mounted in the rear plug of the furnace.

Yet another object of the present invention is to provide an atmosphere seal ring disposed in the rear plug of the furnace at the discharge end. The rear plug includes a water cooling chamber, upon which the atmosphere seal ring is fixedly attached.

It is another object of the present invention to provide a seal ring assembly in which the seal is a furnace seal. This seal is used to keep heat inside of the retort furnace and mounted on the outer furnace shell.

Yet another object of the present invention is to provide a furnace furnace seal ring fixedly attached to the outer furnace shell.

It is a further object of the present invention to provide a furnace seal that is composed of a pair of semi-circular members connected together. Each member is also provided with a copper water cooling ring for countering the intense heat of the retort furnace.

Another object of the present invention provides a furnace seal ring including a water cooling channel disposed along the outside diameter of each of said semi-circular members. The water cooling channel consist of a copper tube located opposite the lubricating means.

A further object of the present invention provides a pin inserted into said metal annular member through a retaining ring to hold the seal assembly in place.

Yet another object of the present invention provides a method of installing rotary retort heat treating furnace seal assemblies. The furnace contemplated by this invention has an outer furnace shell, a retort chamber, a rear plug, a cone casting, and a support ring. The cone casting is positioned at the discharge end of the retort chamber and the cone casting and the support ring are fixedly attached to rotate together with the retort chamber. The method provides for removing the existing seal, generally a graphite rope gasket, and its outside diameter retaining ring. The inside diameter retaining ring is employed by the present invention. A gasket is placed upon the surface of the furnace to receive the seal assembly so that the gasket abuts the inside diameter retaining ring. The metal annular ring of the seal assembly is placed around the inside diameter retaining ring and held in place by drilling through the inside diameter retaining ring and a portion of said metal annular ring. A retaining pin is placed in the drill hole.

Yet another object of the present invention is a method of installing rotary retort furnace seal assemblies where the rotary retort furnace seal assembly is a furnace seal for keeping heat inside of the retort chamber. The furnace seal includes a top half and bottom half of semi-circular aluminum-bronze, connecting means, and a plurality of circular bores fitted with graphite inserts. The gasket is placed on the outer furnace shell such that it abuts the inside retaining ring. The furnace seal is placed on the outer furnace shell by positioning the bottom half of said furnace seal ring on the gasket such that the inside diameter retaining ring abuts bottom half. The bottom half is secured to the inside retaining ring by drilling through the inside diameter retaining ring and a portion of the bottom half and pinning the bottom half to the retianing ring. The top half of said furnace seal ring is placed upon the gasket opposite the bottom half such that the connecting means are aligned. The top half and bottom half are then screwed connected together.

Still another object of the present invention provides a method of installing furnace seal rings such that a cooling water supply is connected to a water inlet port and a cooling water runoff is connected to a water outlet. The water inlet and outlet are connected with a cooling water channel disposed along the outer edge of the furnace seal ring. The furnace seal ring is provided with graphite inserts as a seal lubricant and the gasket provides static biasing of the furnace seal ring to enable sealing engagement between the furnace seal ring and the support ring.

Still another object of the present invention provides a method of installing rotary retort furnace seal assemblies where the rotary retort furnace seal assembly is an atmosphere seal ring for keeping gasses inside of the retort chamber. The rear plug of the furnace includes a water cooling chamber, and the atmosphere seal ring is installed on the exterior surface of the water cooling chamber. The atmosphere seal ring is provided with graphite inserts as a seal lubricant and the gasket provides static biasing of the atmosphere seal ring to enable sealing engagement between the atmosphere seal ring and the support ring.

BRIEF DESCRIPTION OF THE DRAWINGS

The present invention is further explained in the description which follows with reference to the drawings, illustrating, by way of non-limiting examples, various embodiments of the invention, with like reference numerals representing similar parts throughout the several views, and wherein.

DESCRIPTION OF THE PREFERRED EMBODIMENTS

Figure 1:
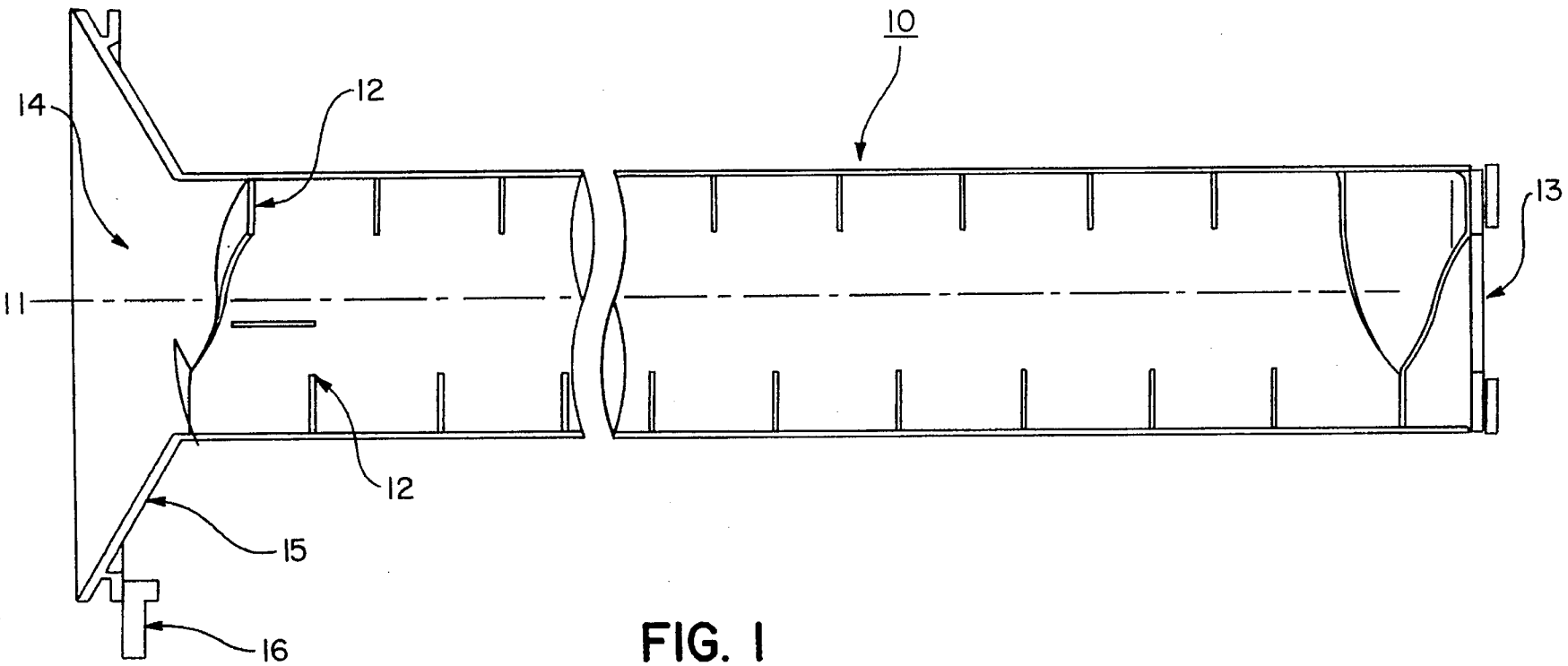
FIG. 1 is a sectional view illustrating the inside of a rotary retort chamber.

Referring now to the drawings in detail, FIG. 1 shows a sectional side view of a retort chamber 10 of a rotary retort heat treating furnace. The retort chamber 10 rotates about a horizontal axis 11 within an outer shell of the furnace (not shown). Inside the retort chamber 10 is a screw type conveyor 12 for advancing product through a retort chamber from a charge end 13 to a discharge end 14. The discharge end 14 of the retort chamber 10 has a cone casting 15 in which the treated product is discharged into a quench bath (not shown). Attached to the cone casting 15 is a support ring 16, shown in more detail in FIGS. 2*a* and 2*b*.

Figure 2B:
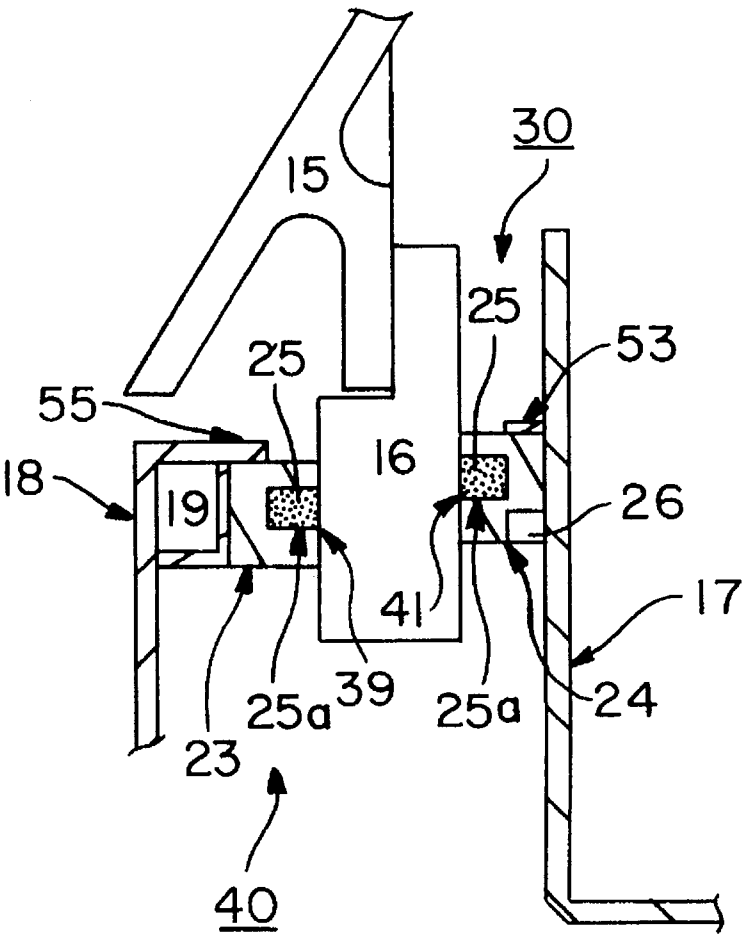
FIG. 2*b* is an expanded view of the rotating support ring and cone casting, showing the seal rings of the present invention.
Figure 2A:
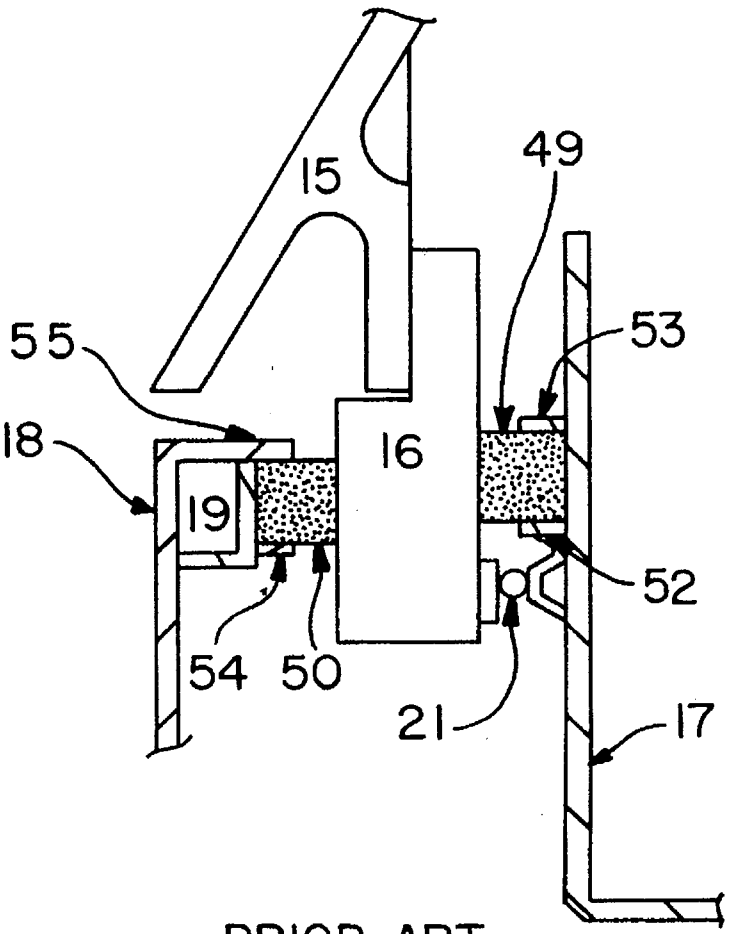
PRIOR ART FIG. 2a
FIG. 2*a* is an expanded view of the rotating support ring and cone casting, showing the prior art rope seals.

FIG. 2*a* shows an expanded view of the cone casting 15 and support ring 16 of the prior art. The figure also shows the outer wall of the furnace 17 and a rear plug 18. Between the outer furnace wall 17 and the support ring is a rope seal 49 of the prior art which prevents heat from escaping from the furnace. The rope seal is held in place by an outside diameter retaining ring 52 and an inside diameter retaining ring 53. A tube 21 is provided for both the input and output of water for cooling the seal assembly area. A water cooling chamber 19 is disposed in the rear plug 18 for cooling that portion of the system. Between the water cooling chamber 19 and the support ring 16 is disposed another rope seal 50 of the prior art which acts to seal atmospheric gases within the retort. The cone casting 15 and a support ring 16 act in unison and rotate between the fixed rope seals 49, 50. Atmosphere seal 50 is held in place between an outside diameter retaining ring 54 and an inside diameter retaining ring 55.

The rope seals 49, 50 of the prior art are generally constructed of fiberglass. Because of the high temperatures within rotary retort furnaces and the-excessive abrasion experienced by the prior art seals, these rope seals are subject to failure. The current life of fiberglass rope seals is reported to be less than 3 months.

To counteract the serious drawbacks of the prior art fiberglass rope seals, FIG. 2*b* shows the rings of the present invention. The present invention shows a furnace seal ring 30 and an atmosphere ring 40, replacing the rope seals 49, 50 of the prior art.

Furnace seal 30 is constructed of an aluminum-bronze material 24. The seal face is provided with a plurality of circular bores 25*a*. Each bore 25*a* is fitted with a graphite insert 25 which acts as a lubricant to enable and maintain sealing engagement at a wear face 41 between the furnace seal 30 and the support ring 16. Furnace ring 30 is held in place by the inside diameter retaining ring 53. The furnace ring is also supplied with a copper water cooling ring 26. The copper water cooling ring 26 replaces the tube 21 of the prior art. By placing the water cooling ring within the furnace seal ring itself, the entire aluminum-bronze seal is cooled via the passing water.

Atmosphere seal 40 is likewise constructed of an aluminum-bronze 23 material. A plurality of graphite inserts 25 are fitted within a plurality of circular bores 25*a* in the seal face. The graphite inserts 25 act as a lubricant to enable sealing engagement at the wear face 39 between atmosphere seal 40 and support ring 16. Atmosphere seal 40 is held in place by inside diameter retaining ring 55.

Figure 3:
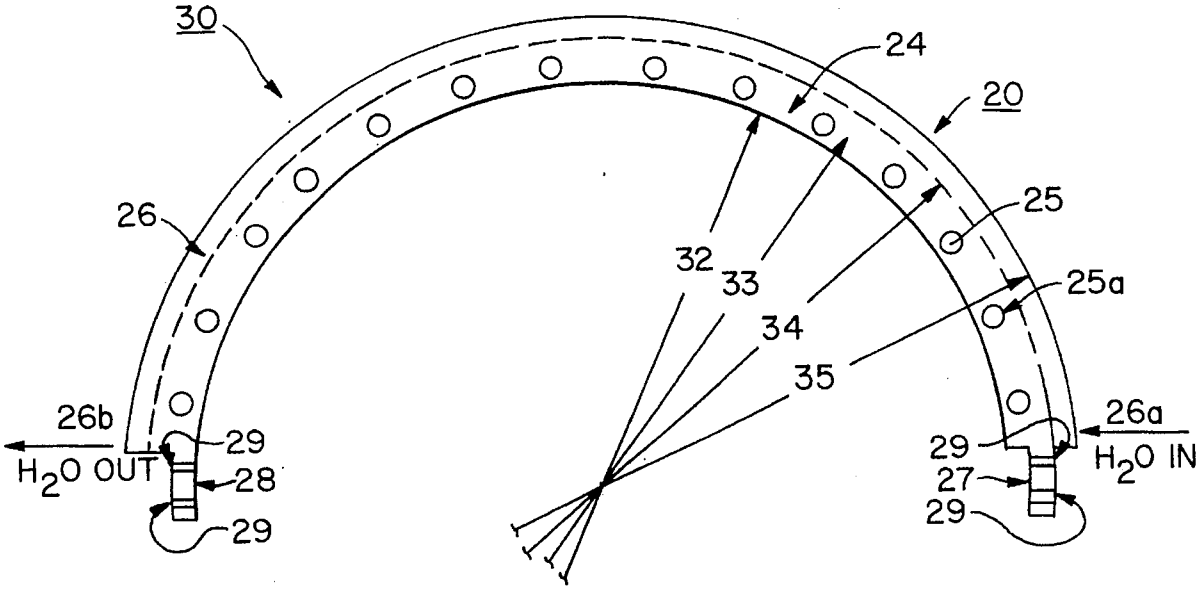

FIG. 3 shows a front view of a portion of furnace seal ring 30. The furnace seal ring 30 composed of a pair of semi-circular members 20, one of which is shown in FIG. 3. The ring is constructed of an aluminum-bronze material 24. Spaced along the face of the semi-circular member 20, and fitted within circular bores 25*a*, are graphite inserts 25. The semi-circular member 20 is comprised of an inside diameter 32, an inside mid-diameter 33, an outside mid-diameter 34, and an outside diameter 35.

Figure 4:
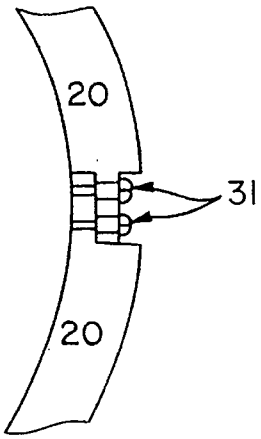
FIGS. 3, 4, 5 and 6 are various views of the furnace seal ring assembly of the present invention.

Furnace ring 30 is completed by connecting two semi-circular members 20 together, as shown in FIG. 4. An inner connector 28 is disposed on one end of the semi-circular ring 20 at a distance between the inside diameter 32 and the inside mid-diameter 33. The other end of the semi-circular ring 20 has a middle connector 27 disposed between the inside mid-diameter 33 and the outside mid-diameter 34. Both connectors are provided with a pair of holes 29 for receiving connecting bolts 31.

Figure 5:
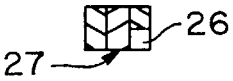
Figure 6:
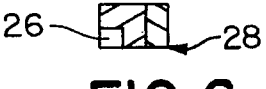

A water cooling system for the furnace seal ring 30 is shown with reference to FIGS. 3, 5, and 6. A water cooling channel 26 is disposed within the semi-circular member 20. The water cooling channel is disposed between the outside mid-diameter 34 and the outside diameter 35. An inlet port 26*a* for the cooling water is provided at the middle connector 27 end of semi-circular member 20. The cooling water enters through 26*a* at the middle connector 27 end, runs through the water cooling channel 26 along the periphery of semi-circular member 20, and exits through an outlet port 26*b* provided at the inner connector 28 end.

Figure 7:
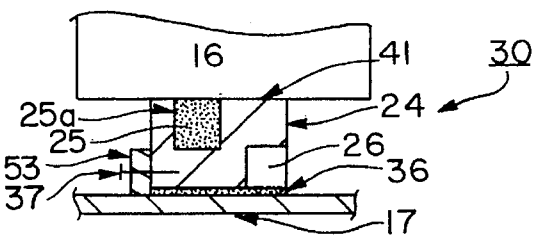
FIG. 7 is a sectional view of the furnace seal ring of the present invention.

FIG. 7 shows an expanded view of the furnace seal ring 30 of the present invention. Shown is outer furnace wall 17 upon which furnace seal ring 30 will be mounted. The present invention may also employ an inside diameter retaining ring 53, such as that of the prior art. A gasket 36 is placed upon the exterior surface of furnace wall 17 so as to abut inside diameter retaining ring 53. Gasket 36 is selected such that its thickness is sufficient to enable proper sealing engagement at a wear surface 41 created between the face of furnace seal ring 30 and the support ring 16. In general, gasket 36 will be approximately 1/16 of an inch thick. The furnace seal ring 30 is held in place by a pin 37 drilled through inside diameter retaining ring 53.

To remove the prior art fiberglass rope gasket and install the furnace seal ring 30 of the present invention, the following simple procedure may be employed. First, the outside diameter retaining ring 52 is removed. Gasket 36 is installed upon outer furnace wall 17. The bottom half of furnace seal ring 30, semi-circular member 20, is placed in contact with the inside diameter retaining ring. The inside diameter retaining ring is drilled through and a portion of furnace seal ring 30 is also drilled. Furnace seal ring 30 is then pinned to the inside diameter retainer member 53 with pin 37. Then the top half of the furnace seal ring 30 is installed. The two semi-circular members 20 are connected together by screws 31. The two semi-circular members 20 are adjusted to a firm position against the inside diameter retaining ring 53 and all screws 31 are finally tightened. Then a water inlet tube is connected to port 26*a* of water cooling channel 26 and an output tube is connected to port 26*b*. Now the furnace seal ring 30 is installed and ready to operate.

Figure 8:
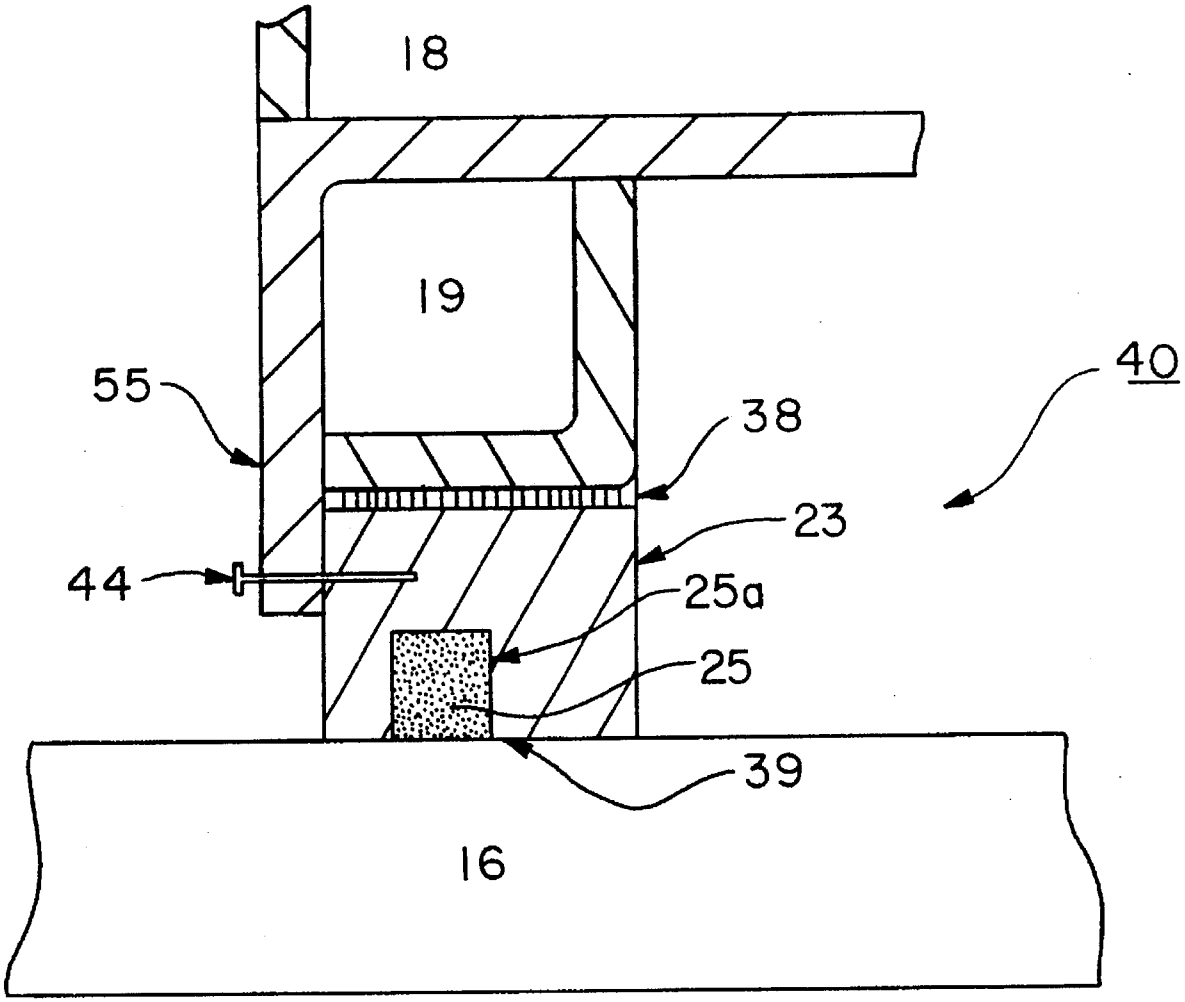
FIG. 8 is a sectional view of the atmosphere seal ring of the present invention.

FIG. 8 shows the atmosphere seal ring 40 of the present invention. Shown is rear plug 18 upon which a water cooling chamber 19 is provided. The atmosphere seal ring 40 will be mounted upon the water cooling chamber 19 providing sealing contact with the support ring 16. Unlike the furnace seal ring 30 of FIGS. 3 and 4, atmosphere seal ring 40 has a one-piece body structure. Thus, the aluminum-bronze material 23 is a singular annular ring. Additionally, because it is mounted upon the cooling water chamber, it is not necessary to provide a separate water cooling channel to the atmosphere seal ring. The atmosphere seal ring 40 of the present invention employs the inside diameter retaining ring 55 of the prior art. A gasket 38 is placed upon the exterior surface of the water cooling chamber 19 so as to abut inside diameter retaining ring 55. Gasket 38 is selected such that its thickness is sufficient to enable proper sealing engagement at a wear surface 39 created between the face of atmosphere seal ring 40 and the support ring 16. In general, gasket 38 will be approximately 1/16 of an inch thick. The atmosphere seal ring 40 is held in place by a pin 44 drilled through inside diameter retaining ring 55.

To remove the prior art fiberglass rope gasket and install the atmosphere seal ring 40 of the present invention, the following simple procedure may be employed. First, the outside diameter retaining ring 54 is removed. Gasket 38 is installed upon the water cooling chamber 19. The atmosphere seal ring 40 is slipped onto inside diameter retaining ring 55. The inside diameter retaining ring 55 is drilled through, as is a portion of the atmosphere seal ring 40. The atmosphere seal ring 40 is then pinned to inside diameter retaining ring 55 by pin 44. Now the atmosphere seal ring 40 is installed and ready to operate.

Figure 9:
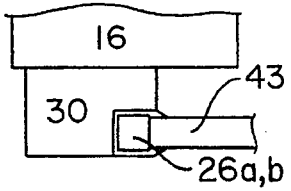
FIG. 9 shows the attachment of the water cooling system to the seal ring of the present invention.

FIG. 9 shows the system of the present invention for supplying and draining water from the furnace seal ring 30. Water cooling inlet port 26*a*, disposed on the middle connector 27 end of the semi-circular member 20, as shown in FIG. 3A, is supplied with a water insertion tube 43. The tube is soldered onto the furnace seal at inlet port 26*a*. The other end of the tube is connected to a cooling water supply (not shown). A similar arrangement is provided at cooling water outlet port 26*b* on the inner connector 28 end of semi-circular member 20 for allowing the cooling water running through channel 26 to drain from the furnace seal (not shown).

Although a preferred embodiment of this invention has been described within this specification, the present invention should not be limited to those embodiments described, nor those illustrated in the drawings. Those ordinarily skilled in the art will note that other arrangements and/or materials may be substituted and/or used without departing from the spirit and scope of the claimed invention.

What is claimed is:

1. A seal ring assembly for sealing a discharge end of a rotary retort heat treating furnace comprising an outer furnace shell, a retort chamber, a rear plug, a cone casting, and a support ring, wherein the cone casting is positioned at the discharge end of the retort chamber and the cone casting and the support ring are fixedly attached to rotate together with the retort chamber, said assembly comprising:

metal annular member;

fixing means attached to said metal annular member for fixedly attaching said metal annular member at the discharge end of the rotary retort furnace;

static biasing means forming a wear surface, wherein said wear surface is disposed between said metal annular member and the support ring, and in sealing engagement therebetween; and wherein said metal annular member is aluminum-bronze and further comprises lubricating means.

2. A seal ring assembly according to claim 1 wherein said lubricating means lubricates said wear surface and comprises a plurality of graphite inserts.

3. A seal ring assembly according to claim 1 wherein said metal annular member comprises a plurality of circular bores; and said circular bores are fitted with said lubricating means.

4. A seal ring assembly according to claim 1 wherein the rear plug is disposed at the discharge end of the rotary retort heat treating furnace and the rotary retort heat treating furnace further comprises a water cooling chamber;

said seal ring assembly comprising an atmosphere seal ring for keeping gasses inside the retort chamber; and said atmosphere seal ring is fixedly attached to the water cooling chamber.

5. A seal ring assembly according to claim 1 wherein the rear plug is disposed at the discharge end of the rotary retort treating furnace and the rotary retort treating furnace further comprises a water cooling chamber;

wherein said seal ring assembly comprising an atmosphere seal ring for keeping gasses inside the retort chamber; and said atmosphere seal ring is fixedly attached to the water cooling chamber;

wherein said metal annular member is aluminum-bronze and comprises a plurality of circular bores;

wherein said plurality of circular bores are fitted with graphite inserts;

wherein said lubricating means comprise said graphite inserts.

6. A seal ring assembly according to claim 1 wherein the said seal ring assembly comprises a furnace seal ring for keeping heat inside the furnace and said furnace seal is fixedly attached to the outer furnace shell.

7. A seal ring assembly according to claim 6 wherein the seal ring assembly comprises of a pair of semi-circular members connected together.

8. A seal ring assembly according to claim 7 wherein a water cooling ring is provided along the outside diameter of each of said semi-circular members;

said water cooling ring comprises a copper tube;

said copper tube is located opposite the lubricating means.

9. A seal ring assembly according to claim 1, wherein said seal ring assembly comprises a furnace seal ring for keeping heat inside the furnace and fixedly attached to the outer furnace shell;

wherein said furnace seal ring is comprised of a pair of semi-circular members;

wherein a water cooling channel is disposed along the outside diameter of each of said semi-circular members;

said water cooling channel further comprises a copper tube;

said copper tube is located opposite the lubricating means;

wherein said metal annular member is aluminum-bronze and comprises a plurality of circular bores;

wherein said plurality of bores are fitted with graphite inserts;

wherein said lubricating means comprise said graphite inserts.

10. A seal ring assembly for sealing a discharge end of a rotary retort heat treating furnace comprising an outer furnace shell, a retort chamber, a rear plug, a cone casting, and a support ring, wherein the cone casting is positioned at the discharge end of the retort chamber and the cone casting and the support ring are fixedly attached to rotate together with the retort chamber, said assembly comprising:

metal annular member;

fixing means attached to said metal annular member for fixedly attaching said metal annular member at the discharge end of the rotary retort furnace, said fixing means comprises a pin inserted into said metal annular member through a retaining ring;

static biasing means forming a wear surface, wherein said wear surface is disposed between said metal annular member and the support ring, and in sealing engagement therebetween; and wherein said metal annular member further comprises lubricating means.

11. A seal ring assembly for sealing a discharge end of a rotary retort heat treating furnace comprising an outer furnace shell, a retort chamber, a rear plug, a cone casting, and a support ring, wherein the cone casting is positioned at the discharge end of the retort chamber and the cone casting and the support ring are fixedly attached to rotate together with the retort chamber, said assembly comprising:

metal annular member;

fixing means attached to said metal annular member for fixedly attaching said metal annular member at the discharge end of the rotary retort furnace;

static biasing means forming a wear surface, wherein said wear surface is disposed between said metal annular member and the support ring, and in sealing engagement therebetween, said static biasing means comprises a gasket; and wherein said metal annular member further comprises lubricating means.

12. A seal ring assembly according to claim 10 wherein the rear plug is disposed at the discharge end of the rotary retort heat treating furnace and the rotary retort heat treating furnace further comprises a water cooling chamber;

said seal ring assembly comprising an atmosphere seal ring for keeping gasses inside the retort chamber; and said atmosphere seal ring is fixedly attached to the water cooling chamber.

13. A seal ring assembly according to claim 10 wherein said seal ring assembly comprises a furnace seal ring for keeping heat inside the furnace and said furnace seal is fixedly attached to the outer furnace shell.

14. A seal ring assembly according to claim 11 wherein the rear plug is disposed at the discharge end of the rotary retort heat treating furnace and the rotary retort heat treating furnace further comprises a water cooling chamber;

said seal ring assembly comprising an atmosphere seal ring for keeping gasses inside the retort chamber; and said atmosphere seal ring is fixedly attached to the water cooling chamber.

15. A seal ring assembly according to claim 11 wherein said seal ring assembly comprises a furnace seal ring for keeping heat inside the furnace and said furnace seal is fixedly attached to the outer furnace shell.

* * * * *